United States Patent [19]

Ogawa

[11] 4,186,515

[45] Feb. 5, 1980

[54] TOY HORSE VEHICLE

[75] Inventor: Iwakichi Ogawa, Kashiwa, Japan

[73] Assignee: Takara Co., Ltd., Tokyo, Japan

[21] Appl. No.: 863,213

[22] Filed: Dec. 22, 1977

[51] Int. Cl.[2] ..... A63H 33/00

[52] U.S. Cl. ..... 46/22; 46/241

[58] Field of Search ..... 46/17, 22, 167, 161, 46/241

[56] References Cited

U.S. PATENT DOCUMENTS

| | | | |
|---|---|---|---|
| 3,068,615 | 12/1962 | Nassour | 46/22 |
| 3,090,155 | 5/1963 | Gordon | 46/22 |
| 3,246,422 | 4/1966 | Teagarden | 46/22 |
| 3,375,604 | 4/1968 | Alonso | 46/22 |
| 3,952,449 | 4/1976 | Terzian | 46/161 |
| 4,038,775 | 8/1977 | Sato | 46/22 |
| 4,118,888 | 10/1978 | Ogawa | 46/22 |

*Primary Examiner*—Louis G. Mancene
*Assistant Examiner*—Mickey Yu
*Attorney, Agent, or Firm*—Jackson, Jones & Price

[57] ABSTRACT

A toy assembly capable of being configured into a simulated horse is provided. The body member contains a pivotal connection that is rotatively attached to a joint assembly configured and positioned on the body member to represent respectively the withers and breast of the horse. A removable appendage member configured and operatively positioned on the joint assembly represents the horse's neck and head. The appendage member can be removed and replaced with the upper torso of a humanoid robot. A magnet assembly in the body of the horse is additionally capable of securing removable accessory parts.

16 Claims, 7 Drawing Figures

FIG. 1
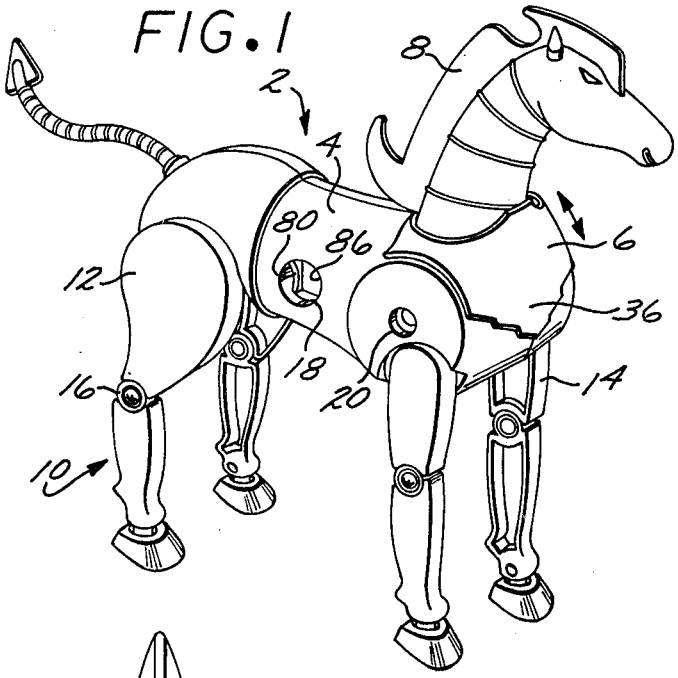
FIG. 2
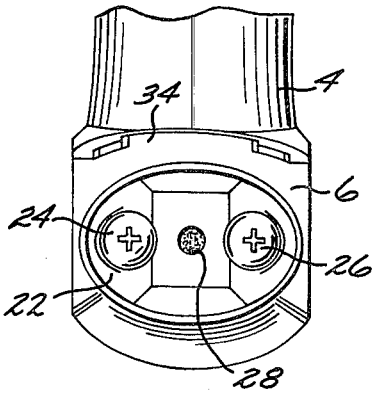
FIG. 3
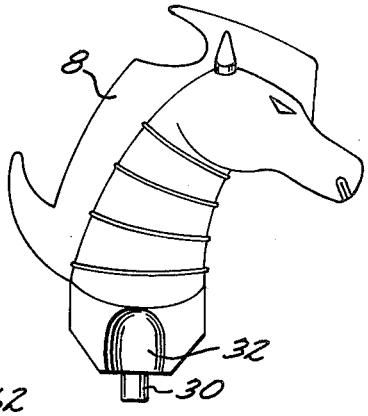
FIG. 7
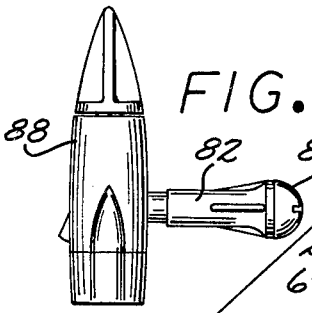
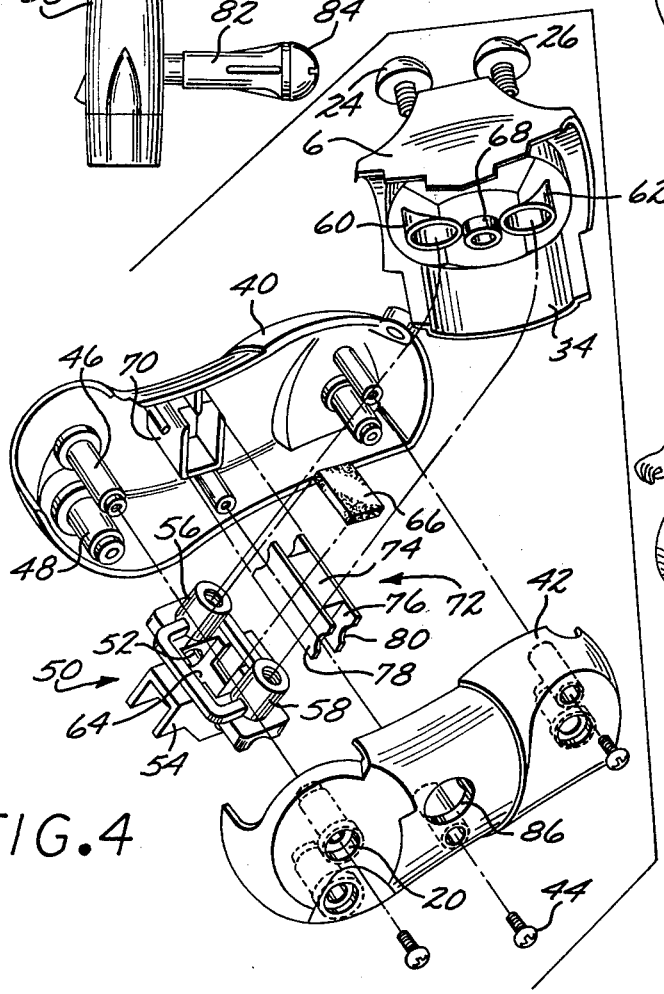
FIG. 4
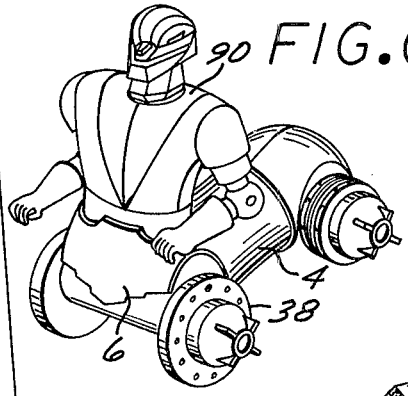
FIG. 6
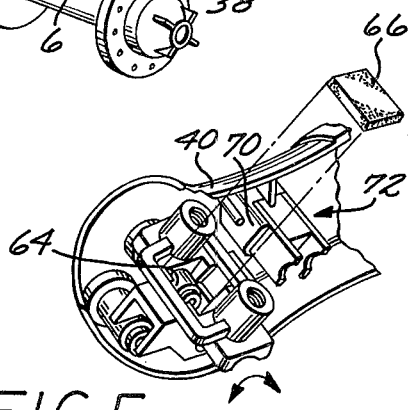
FIG. 5

TOY HORSE VEHICLE

BACKGROUND OF THE INVENTION

1. Field of the Invention

The present invention is directed to a versatile toy assembly having removable appendages and more particularly to a toy assembly capable of being configured into a simulated horse with a pivotal head mounting.

2. Description of the Prior Art

Various forms of simulated horse toys have been provided in the toy industry. Additionally, the use of magnets to attach removable appendages is also known in the toy industry as can be seen from the Satoh U.S. Pat. No. 4,038,775.

More particularly, examples of animal figures with detachable appendages are known, such as the Alonso U.S. Pat. No. 3,375,604, Gordon U.S. Pat. No. 3,090,155 and Nassour U.S. Pat. No. 3,068,615. Generally, the prior art configurations have had a limited play option. There is still a demand in the prior art to provide unique and novel features in versatile configurations to appeal to children.

SUMMARY OF THE INVENTION

The present invention provides a versatile toy having a housing member configured to resemble the body of a horse. Various supportive means can be provided such as removable appendages configured to resemble the legs of a horse or wheels. A pivotal connection assembly is attached to the interior of the housing member and includes a pivotal mounting post and a sleeve assembly mounted on the mounting post. The sleeve assembly includes a friction pad to permit a subjective positional alignment of the sleeve assembly as desired. A joint assembly is attached to a sleeve assembly and is configured to represent a horse's withers and breast. The top of a joint assembly provides an exterior cavity containing a pair of magnetizable approximately hemispherical members. A removable upper housing assembly can be connected to the joint assembly. In the preferred embodiment, the upper housing assembly is configured to represent a horse's neck and head. Alternative upper housing assemblies can be attached in the exterior cavity such as an upper torso of a robot humanoid. Finally, various appendages can be removably attached to the body member thereby permitting various subcombinations of toy assemblies. These subcombinations will be limited only by the imagination of a child.

The features of the present invention which are believed to be novel, are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a front perspective view of an assembled toy of the present invention;

FIG. 2 is a partial plan view of a joint assembly;

FIG. 3 is a side view of a removable upper housing assembly configured to represent a horse's neck and head;

FIG. 4 is an exploded perspective view of the housing member of the present invention;

FIG. 5 is a partial exploded view of the housing member of the present invention.

FIG. 6 is a front perspective view of an alternative configuration; and

FIG. 7 is a side view of a removable appendage member.

BRIEF DESCRIPTION OF THE PREFERRED EMBODIMENT

The following description is provided to enable persons skilled in the toy industry to make and use the invention and sets forth the best modes contemplated by the inventor of carrying out his invention. Various modifications, however, will remain readily apparent to those skilled in the art, since the generic principles of the present invention have been defined herein specifically to provide a toy assembly that can be manufactured in a relatively economical manner. The mode of the present invention specifically described in the accompanying drawing is in the form of a toy assembly configured into a simulated horse. Variations of this design structure to provide other forms of toy designs within the parameters of the present invention is quite possible.

Referring to the perspective view of FIG. 1, the toy assembly 2 has an exterior configuration simulated that of a horse and more particularly of a mechanical horse. The body or housing member 4 is configured to represent a horse's body and is supported by a plurality of removable appendages which form support means. The removable appendages can include articulated hind legs 12 having an articulated joint 16 while the fore legs 14 also include articulated joints. The articulated joints permit the legs to be positioned in various positions to suggest for example, that the horse assembly 2 is running or standing. Bores 20 are provided to receive fastening screws 44 to hold the housing member shells 40 and 42 together.

A relatively movable joint assembly 6 is configured and positioned on the body member 4 to represent respectively the withers and breast of a horse. This joint assembly is pivotally connected to the interior of the body member 4 and can be relatively movable and held in any aligned position that is desired. As can be seen from FIG. 2, the joint assembly 6 includes an upper exterior cavity 22 containing a pair of magnetizable approximately hemispherical screws 24 and 26. In the center of the cavity 22 is an open-ended bore 28 which provides fastening means for securing at least one of the removable upper housing assemblies 8. Preferably the component parts utilized in the present invention are primarily made from plastic although other types of material can be used.

As can be seen in FIG. 3, the upper housing assembly 8 can be configured to represent the neck and head of a horse. A lower mounting post 30 is dimensioned to provide a press fit male stud member in a female cavity bore 28. A pair of side concave cavities 32 are provided on either side of the base of the upper housing assembly 8 to accommodate respectively the hemispherical heads of the screws 24 and 26. The joint assembly 6 has a rear peripheral skirt 34 which extends into the back of the body member 4 as can be seen in FIG. 2. The front skirt 36 overlaps the breast portion of the front of the body member 2.

Referring to FIG. 4, an exploded perspective view of the present invention is disclosed. The body or housing member 4 includes the pair of half shells 40 and 42. The half shells are joined together by a plurality of screws 44. A portion of the mounting post 46 can be molded onto the interior of shell 40. The cantilevered end of the mounting post 46 can have a bore which is approximately threaded to receive one of the screws 44 and also to align with the other half of the mounting post 46 on the other shell 42. The other half of the mounting post is hollow to receive the screw 44.

A plurality of additional securement posts can be positioned on the half shell 40 to respectively align with complimentary hollow posts on the other shell 42 to both strengthen and provide threaded bores for the other screws 44. Below and somewhat forward of the mounting post 46 is an alignment post 48. Rotatively mounted on the mounting post 46 is a sleeve assembly 50 having a bore opening 52 that extends longitudinally through the body of the sleeve assembly 50 for receiving the mounting post 46. On either side of the sleeve assembly 50 are alignment shoulders 54. The forward alignment shoulder 54 can contact the alignment post 48 to limit the forward rotatable movement of the sleeve assembly 50. A pair of threaded cylinder columns 56 and 58 are positioned on top of the sleeve assembly 50 and are adapted to being positioned within the female cylinder bores 60 and 62 on the underside of the joint assembly 6. The respective threaded cylinder columns 56 and 58 receive the hemispherically headed screw members 24 and 26 when positioned within the female cylinder bores 60 and 62 respectively.

The sleeve assembly 50 has a vertical opening or cavity 64 that is adapted to receive a friction member in the form of a resilient rubber pad 66. As can be seen in FIG. 5, the mounting post 46 is exposed in the sleeve cavity 64 and the friction pad 66 rests on the top of the mounting post 46. Actually, both halves of the mounting post 46 extend within the cavity 64 to contact the friction member 66. As can be readily appreciated, one body shell can contain a mounting post that could extend entirely across the interior of the shells if desired and it would perform in the same manner.

When the joint assembly 6 is secured onto the sleeve assembly 50 by the hemispherical screws 24 and 26, a pressure member 68 in the form of a projecting cylinder 68 extends downward from the bottom of the joint assembly 6 to rest against the upper half of the friction pad 66. Depending on degree of tightening of the hemispherical screws 24 and 26, the pressure member 68 will force the friction pad 66 against both halves of the mounting post 46. Accordingly, this friction is sufficient to retain any relative rotatable position of the joint assembly 6 about the mounting post 46. Thus, the upper housing assembly 8 can be rotated throughout its limited travel and held in any desired position throughout that limited travel.

A magnet support receptacle 70 is integrally molded inside of each body shell 40 and 42. For ease of illustration, the receptacle 70 is only shown on half shell 40, it should be realized that an identical matching receptacle is also provided on half shell 42. A magnet assembly 72 is mounted in the respective receptacles and comprises a square magnet 74 that is sandwiched between a pair of flat pole pieces 76 and 78 respectively. Each pole piece has an arcuate joint 80 provided at the end of each pole piece. This provides magnetizable joints that are accessible from the exterior of the body member through appropriate bores 86.

As can be seen from FIG. 7, a mounting appendage member 82 having a magnetizable spherical head 84 can be mounted on the magnetic arcuate joint 80 through one bore 86 on the side of the body member 4. The other side of the body member 4 has an identical magnetizable joint. Accordingly, a projectile firing mechanism 88 could be mounted by a press fit joint to the mounting appendage member 82 to provide an additional play action for the child.

Referring to FIG. 6, the upper torso body portion 90 of a robot can be mounted in the joint assembly exterior cavity 22. If the robot has a pair of arcuate joints similar to that of the magnetic arcuate joint 80, they are adhered by the magnetic force to the respective hemispherical screw members 24 and 26 which are exposed in the cavity 22. As can be appreciated, the rotatable joint assembly 6 can permit the movement of the upper housing assembly 8, be it in the configured form of a horse or of the torso of a robot.

Referring again to FIG. 4, the body half shells 40 and 42 can be joined together so that the respective halves of the mounting post 46 captures the sleeve assembly 50. The friction pad 66 can be mounted within the cavity 64 of the sleeve assembly 50 so that it rests on the top of the mounting post 46 and, in fact, on both halves. The joint assembly 6 can be mounted on the sleeve assembly 50 so that the threaded cylinder columns 56 and 58 fit within the female receptacles 60 and 62. The hemispherical screws 24 and 26 are then appropriately threaded into the threaded cylinder columns 56 and 58. The pressure member 68 on the lower portion of the joint assembly 6 bears directly on the friction pad 66 and holds it tightly against the mounting post 46.

Prior to the assembling of the half shells 40 and 42, the magnetic assembly 72 can be appropriately aligned and placed within the respective magnetic receptacles 70 as partially shown in FIG. 5. Screws 44 are used to hold the half shell body members 40 and 42 together. The support appendages such as the legs 12 and 14 or the wheel assemblies 38 can be press-fitted into appropriate bores to provide operative support means.

A removable upper housing assembly 8 such as the simulated neck and horse head 8 can be mounted in the upper exterior cavity 22 of the joint assembly 6. As seen in FIG. 6, an alternative upper housing assembly such as the upper torso of a robot figures 90 can be utilized.

The joint assembly 6 is manually rotatable about its pivotal connection assembly which comprises the mounting post 46 and the sleeve assembly 50. Thus, a child can position it as desired and the interface of the friction pad 66 with the mounting post 46 will insure that the particular desired alignment is maintained.

The arcuate magnetic joints 80 can be contacted from outside of the body 4 through the appropriate bores 86 in both half shells 40 and 42. Accordingly, a removable magnetizable appendage member such as shown in FIG. 7 can be secured to the magnetic arcuate joints 80 through an appropriate bore 86. While a rocket projectile member 88 is disclosed in FIG. 7, it should be readily understood that other removable appendage members could be utilized. Thus, the present invention provides a versatile play action toy assembly for a child.

Various modifications would be readily apparent to a person skilled in this field and accordingly, the parameters of the present invention should be measured solely from the following claims wherein I claim:

1. A versatile toy assembly capable of being combined into various toy configurations such as a simulated horse or a centaur comprising;

a body member configured to simulate the body of a horse;

support means removably connected to the body member;

a pivotal connection assembly attached to the interior of the body member;

a joint assembly configured and positioned on the body member to represent respectively the withers and breast of a horse with an upper cavity containing a pair of magnetizable members, and a pair of removable appendage members configured to simulate respectively a horse's neck and head and the upper torso, head and upper arms of a humanoid, each appendage member having complimentarily magnetizable connectors for co-action with the joint assembly magnetizable members, the joint assembly is connected to the pivotal connection assembly to permit movement of an attached appendage member relative to the body member.

2. The invention of claim 1 wherein the pivotal connection assembly includes a pivotal mounting post and a sleeve assembly mounted on the pivotal mounting post.

3. The invention of claim 2 further including a friction member and the sleeve assembly further includes friction mounting means for positioning the friction member adjacent the pivotal mounting post.

4. The invention of claim 3 wherein the joint assembly is mounted on the sleeve assembly and bears on the friction member.

5. The invention of claim 4 wherein each magnetizable member is configured into a hemispherical shape and has a threaded stem and the sleeve assembly further has a threaded bore for receiving the threaded stem, the pivotal connection assembly being fastened to the sleeve assembly by the hemispherical members.

6. The invention of claim 4 wherein the friction member is a rubber pad.

7. The invention of claim 2 wherein the body member includes an alignment post and the sleeve assembly includes at least one alignment shoulder for contacting the alignment post to limit the pivotal movement.

8. The invention of claim 2 further including a magnet and a pair of pole pieces wherein the housing member includes positioning means for receiving the magnet with the pole pieces on either side.

9. The invention of claim 2 wherein the magnetizable members interconnect the joint assembly and the sleeve assembly.

10. The invention of claim 1 wherein the support means includes a pair of wheel assemblies.

11. The invention of claim 12 wherein the support means includes a pair of wheel assemblies.

12. A toy assembly capable of being configured into a simulated horse comprising;

a body member;

support means removably connected to the body member;

a pivotal connection assembly attached to the interior of the body member;

a joint assembly configured and positioned on the body member to represent respectively the withers and breast with an upper cavity containing a pair of magnetizable members, and a removable appendage member configured and operatively positioned on the joint assembly to represent a horse's neck and head, the joint assembly is connected to the pivotal connection assembly to permit movement of the appendage member relative to the body member.

13. The invention of claim 12 wherein the pivotal connection assembly includes a pivotal mounting post connected to the body member and a sleeve assembly mounted on the mounting post.

14. The invention of claim 13 wherein the sleeve assembly further includes a resilient pad for providing a frictional interface with the mounting post.

15. The invention of claim 14 wherein the magnitizable members interconnect the joint assembly and the sleeve assembly.

16. A versatile toy assembly comprising;

a body member configured to simulate the body of a horse;

support means removably connected to the body member;

a pivotal connection assembly attached to the interior of the body member;

a joint assembly configured and positioned on the body member to represent respectively the withers and breast of a horse with an upper cavity containing a pair of magnetizable members, and a removable appendage member configured to simulate the upper torso, head and upper arms of a humanoid, the appendage member having complimentarily magnetizable connectors for co-action with the joint assembly magnetizable members, the joint assembly is connected to the pivotal connection assembly to permit movement of an attached appendage member relative to the body member.

* * * * *